US006668790B2

(12) United States Patent
Chmela et al.

(10) Patent No.: US 6,668,790 B2
(45) Date of Patent: Dec. 30, 2003

(54) METHOD OF OPERATING AN INTERNAL COMBUSTION ENGINE OPERATED ON GASOLINE TYPE FUELS

(75) Inventors: Franz Chmela, Graz (AT); Janos Csato, Graz (AT); Michael Glensvig, Graz (AT)

(73) Assignee: AVL List GmbH, Graz (AT)

( * ) Notice: Subject to any disclaimer, the term of this patent is extended or adjusted under 35 U.S.C. 154(b) by 153 days.

(21) Appl. No.: 10/067,806

(22) Filed: Feb. 8, 2002

(65) Prior Publication Data

US 2002/0121263 A1 Sep. 5, 2002

(30) Foreign Application Priority Data

Feb. 8, 2001 (AT) ..... 98/2001 U

(51) Int. Cl.[7] ..... F02B 17/00

(52) U.S. Cl. ..... 123/295; 123/305; 123/294; 123/430

(58) Field of Search ..... 123/295, 294, 123/305, 430

(56) References Cited

U.S. PATENT DOCUMENTS

| | | | | |
|---|---|---|---|---|
| 5,535,716 A | | 7/1996 | Sato et al. | |
| 6,006,716 A | * | 12/1999 | Harada et al. | 123/295 |
| 6,267,097 B1 | * | 7/2001 | Urushihara et al. | 123/305 |

FOREIGN PATENT DOCUMENTS

| | | |
|---|---|---|
| AT | 03135 | 10/1999 |
| DE | 2031455 | 1/1972 |
| DE | 19818596 | 11/1989 |
| DE | 4030248 | 4/1992 |
| EP | 1048833 | 11/2000 |

OTHER PUBLICATIONS

A. Gary et al., "Homogeneous Charge Compression Ignition (HCCI) of Diesel Fuel" in SAE 971676, May 5–8, 1997.

T. Aoyama et al., "An Experimental Study on Premixed–Charge Compression Ignition Gasoline Engine" in SAE 960081, Feb. 26–29, 1996.

* cited by examiner

*Primary Examiner*—Bibhu Mohanty
(74) *Attorney, Agent, or Firm*—Dykema Gossett PLLC

(57) ABSTRACT

The invention relates to a method of operating an internal combustion engine operated on gasoline type fuels, more specifically on gasoline, wherein ignition of the fuel-air mixture is initiated spontaneously in at least one operational range of the engine, preferably in the part load range, and wherein a stratified charge is produced in the combustion chamber, preferably in the higher load range. In order to achieve in the simplest possible manner high exhaust quality for an internal combustion engine operated on fuel with poor ignition characteristics in the range of higher mean pressures as well there is provided that combustion is initiated by spontaneous ignition of the fuel in the full load range as well and that preferably the in-cylinder charge temperature is controlled throughout the load range by way of internal exhaust gas recirculation and that, in the full load range, the start of fuel injection occurs after top dead center.

8 Claims, 1 Drawing Sheet

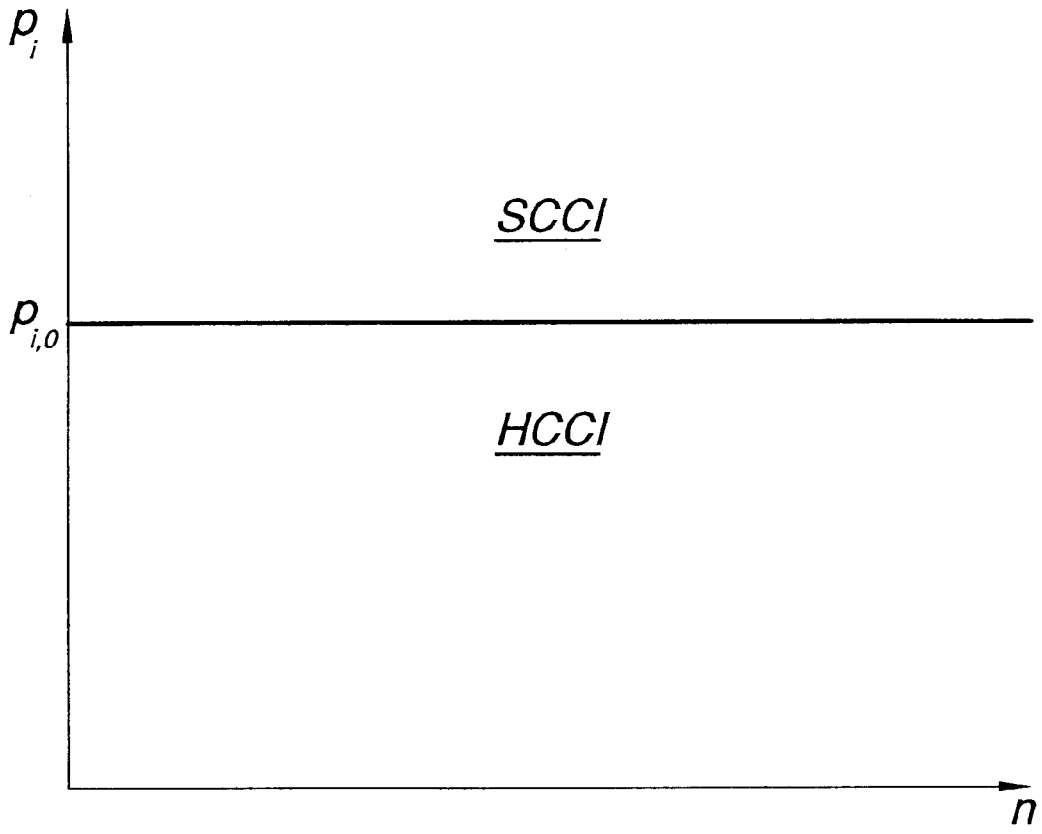
$p_i$
SCCI
$p_{i,o}$
HCCI
n

METHOD OF OPERATING AN INTERNAL COMBUSTION ENGINE OPERATED ON GASOLINE TYPE FUELS

BACKGROUND OF THE INVENTION

The invention relates to a method of operating an internal combustion engine operated on gasoline type fuels, more specifically on gasoline, wherein ignition of the fuel-air mixture is initiated spontaneously in at least one operational range of the engine, preferably in the part load range, and wherein a stratified charge is produced in the combustion chamber, preferably in the higher load range.

The term gasoline type fuels designates not only gasoline, but also other blends of hydrocarbons, gases, liquid hydrocarbons made from natural gas and alcohol.

DESCRIPTION OF PRIOR ART

The publication entitled "Homogeneous Charge Compression Ignition (HCCI) of Diesel Fuel", Allen W. Gray et al., SAE Paper No. 971676 discloses that extremely low $NO_x$ and soot emissions are obtained during combustion of an auto-ignited lean fuel-air mixture on account of the homogeneous distribution of concentration and temperature.

It is also known that, on account of its high ignition property, diesel fuel is compounding the difficulty of carrying out this combustion process because the time of ignition can be fixated as desired just before top dead center only when the compression ratio and the engine load are low. As compared to conventional diesel processes, the low compression ratio required results in considerable disadvantages regarding specific fuel, said disadvantages having, together with the low achievable power production, heretofore prevented this process from being more widely used although it yields favorable emission ratings.

Another difficulty specific to diesel fuel is the position of the boiling range between approximately 170° C. and 360° C. that hinders vaporation and accordingly homogenization of the cylinder charge and that may yield high $NO_x$, soot and unburned hydrocarbon emissions and involves the risk of diesel fuel mixing with the lubricant.

For HCCI combustion, gasoline presents great advantages on account of its low autoignition quality and the lower gasoline boiling range of between approximately 30° C. and 190° C. Analogous to the diesel engine, the compression ratio may here be raised to values of about 15 to 17. Although the achievable indicated mean effective pressure is higher than with diesel fuel, it remains limited to the part load range as may be gathered from the publication entitled "An Experimental Study on Premixed-Charge Compression Ignition Gasoline Engine", Taro Aoyama et al., SAE Paper No. 960081. Special tests yielded a maximum indicated mean effective pressure of approximately 7 to 8.5 bar. Accordingly, and in order to be capable of covering the whole operational range up to 20 bar, a second combustion system capable of high load is required.

For this second combustion process, the document AT 003 135 U1 suggests a Stratified Charge Spark Ignition process (SCSI-process in short).

A conventional stoichiometric process with spark ignition, lambda sensor and three-way catalytic converter (HCSI-process in short for Homogeneous Charge Spark Ignition) may also be used as a second combustion process. The HCSI operation requires a compression ratio of about 10, which means that, on passing from low load to high load, the compression ratio must be lowered from about 16 (HCCI) to about 10 (HCSI). This is only possible with considerable constructional expenditure. With this method, high indicated mean effective pressures of more than 20 bar are possible.

The SCSI-process mentioned operates with a compression ratio similar to that of a diesel engine, i.e., of about 16 as well, which presents the advantage that in case HCCI operation (low load) is combined with SCSI operation (high load), there is no need to change the compression ratio. As compared to HCSI operation, this additionally has the advantage of a higher thermal efficiency in the higher load range. Special tests yielded a maximum indicated mean effective pressure of about 12 bar for SCSI operation.

An important principle of SCSI operation is that the ignition delay for spontaneous ignition—also assisted by the reaction retarding means of exhaust gas recirculation—would be considerably longer than with a direct injection diesel engine. With spark ignition, the start of ignition may be selected freely within the ignition delay mentioned. By virtue of the thus possible, relatively long, but accurately controllable carburetion duration between the start of injection and the start of combustion, soot emissions may be considerably reduced over a direct injection, autoignition combustion process.

At even higher mean pressures, it proved to become increasingly difficult to suppress spontaneous auto-ignition before the desired start of combustion due to the rise of the temperature level. To this purpose it would be necessary to lower the compression ratio, which would require, as already mentioned, a complex construction and would penalize efficiency, and to have a higher exhaust gas recirculation rate that would on the other hand increase soot emissions, so that the long duration of carburetion would no longer make sense.

U.S. Pat. No. 5,535,716 describes a spontaneous ignition gasoline-fueled internal combustion engine in which the fuel is indirectly injected into an intake runner.

The DE 2 031 455 A discloses a spontaneous ignition air compression internal combustion engine for operation on fuels with poor ignition characteristics. Part of the exhaust gas is externally recirculated from the exhaust line to the intake line by way of a controller.

The publication DE 198 18 596 A1 discloses a process for operating a four-stroke internal combustion engine on a homogeneous, lean basic mixture of air, fuel and retained exhaust gas with compression ignition and direct fuel injection into a combustion chamber. At part load, the internal combustion engine is operated with compression ignition and mechanically controlled exhaust gas retention. At full load and in the high part load range, the engine is operated in the Otto mode.

The document EP 1 048 833 A2 teaches to utilize internal exhaust gas recirculation to control combustion in a spontaneous ignition or spark ignition internal combustion engine.

SUMMARY OF THE INVENTION

It is the object of the invention to avoid the drawbacks mentioned in the range of high mean pressures and to achieve in the simplest possible manner high exhaust quality and concurrently high efficiency for an internal combustion engine operated on fuel with poor ignition characteristics in the range of higher mean pressures as well.

This is achieved in accordance with the invention in that combustion is initiated by spontaneous ignition of the fuel in the full load range as well and in that preferably the in-cylinder charge temperature is controlled throughout the load range by way of internal exhaust gas recirculation and in that, in the full load range, the start of fuel injection occurs after top dead center. The full load range designates here a range including the full load line with high load from a predetermined limit for the indicated mean pressure. By increasing the charge temperature and additionally by pilot injection, the ignition delay, which is longer with gasoline than with diesel fuel, may be shortened, but not enough. In order to shorten ignition delay further, the fuel is injected at full load only from top dead center, the whole quantity of fuel being injected in the full load range within the region of ignition delay. Accordingly, the internal combustion engine is operated at full load in the auto-ignition mode with spontaneous ignition of a stratified, that is to say heterogeneous charge (SCCI process in short for Stratified Charge Compression Ignition). As compared to the diesel process with diesel fuel, the process can benefit from the lesser tendency of gasoline to form soot and compared with the stoichiometric process it presents the advantage, based on the high compression ratio, of higher efficiency, which makes the combination of HCCI at low loads and of SCCI at higher loads particularly interesting for utility engines.

Compared with the combination of HCCI operation and HCSI operation mentioned, this internal combustion engine presents a series of characteristics that are well known in diesel engines. The compression ratio amounts to between about 15 and 19, preferably between 16 and 18, so that the actual efficiency is comparable to that of a diesel engine. As contrasted with the combination of HCCI and HCSI, a variable compression ratio may be dispensed with. The maximum effective mean pressures may be expected to reach values on the same order, i.e., of about 25 bar.

The combustion always occurs with excess air, just as with the diesel engine, which also has a positive effect on the specific fuel consumption.

In order to achieve particularly favourable soot and $NO_x$ emissions, it is particularly advantageous when an at least almost homogeneous fuel-air mixture is produced in the part load range. In the two partial processes (HCCI and SCCI), the control of combustion occurs through a control of the charge temperature that is assigned to the cycles. To control combustion by way of the charge temperature history forms the subject of the Austrian Utility Model Application No. 727/2000 of the applicant. The control of the charge temperature may thereby among others be advantageously carried out by recirculating the exhaust gas during the intake stroke through subsequent opening of the exhaust valve.

At least in the higher load range, the fuel may be directly injected into the combustion chamber, although the injection pressure may be lower than with the diesel engine. In the part load range, it may be of advantage to inject the fuel into the suction pipe to achieve good homogenisation.

To change the method of forming a mixture, which is necessary when switching between homogeneous and stratified operation, it is possible to either switch from suction pipe injection to direct injection or to use an injection facility with variable injection pressure level and/or an injection nozzle with two spray hole configurations when direct injection is continuous.

By means of cooled exhaust gas recirculation, a basic setting of the temperature may be carried out in HCCI operation and in SCCI operation $NO_x$ emissions may be reduced.

BRIEF DESCRIPTION OF THE DRAWING

The FIGURE shows a schematic in which the indicated mean pressure $p_1$ is plotted over the number of revolutions n. The switching between HCCI operation and SCCI operation advantageously occurs in function of the indicated mean pressure $p_1$ or of the quantity of fuel per operating cycle, as shown in the FIGURE. The HCCI range is located below a predetermined limit $p_{1,0}$, amounting to between 4 and 9 bar, preferably between 6 and 9 bar, a limit of between 7 and 8.5 bar being of particular preference, whereas the SCCI range is located above said limit $p_{1,0}$.

DETAILED DESCRIPTION OF THE METHOD

Furthermore, to combine the HCCI and SCCI processes also makes sense because the idea to process fuels with poor auto-ignition characteristics throughout the load range according to the conventional diesel process is generally difficult to realize. The reason therefore is the tendency to incomplete combustion at part load, i.e., at low component and charge temperatures.

In renouncing the HCCI process with its excellent emission data with regard to soot and $NO_x$ at part load, the variant of the conventional diesel process mentioned is still of interest in the whole load range when used in utility engines. As also required for the HCCI process, the disadvantages mentioned can be reduced in rising the charge temperature level by recirculating the exhaust gas. This renunciation can be justified in that, with utility engines, the share of low load emissions in the result of the cycle is comparatively low. A significant advantage of this solution, i.e., the pure diesel engine operation with gasoline-like fuels throughout the entire speed and load range, is that it overcomes the difficulties experienced in HCCI operation in controlling the start of combustion and the combustion rate.

What is claimed is:

1. A method of operating an internal combustion engine operated on gasoline type fuels, more specifically on gasoline, wherein ignition of the fuel-air mixture is initiated spontaneously in at least a part load range of the engine, and wherein a stratified charge is produced in the combustion chamber, in a higher load range wherein combustion is initiated by spontaneous ignition of the fuel in the full load range as well and wherein, in the full load range, the start of fuel injection occurs after top dead center.

2. The method of claim 1, wherein, in the full load range, the whole quantity of fuel is injected within the region of ignition delay.

3. The method of claim 1, wherein an in-cylinder charge temperature is controlled throughout the load range by way of internal exhaust gas recirculation.

4. The method of claim 1, wherein, in the part load range, an at least almost homogeneous fuel-air mixture is produced.

5. The method of claim 1, wherein, at least in the higher load range, the fuel is directly injected into the combustion chamber.

6. The method of claim 1, wherein, the lower load range, the fuel is injected into the suction pipe.

7. The method of claim 1, wherein, in the part load range, a stratified charge is produced in the combustion chamber.

8. The method of claim 1, wherein, during engine cold start below a predetermined ambient temperature, the ignition of the fuel is initiated by way of a glow plug.

* * * * *